US005410242A

United States Patent [19]

Bittner

[11] Patent Number: 5,410,242

[45] Date of Patent: Apr. 25, 1995

[54] CAPACITOR AND RESISTOR CONNECTION IN LOW VOLTAGE CURRENT SOURCE FOR SPLITTING POLES

[75] Inventor: Harry J. Bittner, Santa Clara, Calif.

[73] Assignee: Micrel, Inc., San Jose, Calif.

[21] Appl. No.: 187,579

[22] Filed: Jan. 26, 1994

[51] Int. Cl.[6] ..... G05F 3/16; G05F 3/20

[52] U.S. Cl. ..... 323/315

[58] Field of Search ..... 323/315, 312

[56] References Cited

U.S. PATENT DOCUMENTS 4,645,999 2/1987 Szepesi ..... 323/315

*Primary Examiner*—Steven L. Stephan

*Assistant Examiner*—E. To

*Attorney, Agent, or Firm*—Skjerven, Morrill, MacPherson, Franklin & Friel; Brian D. Ogonowsky

[57] ABSTRACT

One embodiment of this invention provides an improved version of an existing current source circuit. A reduction in die size of the current source is achieved by modifying the circuit to enable a reduction in the capacitance of its feedback capacitor while improving the frequency compensation of its feedback loop. The modification changes the location of the dominant pole in the circuit and utilizes Miller multiplication to increase the effect of the feedback capacitor. The modification also uses pole splitting to further ensure that the feedback loop will not oscillate.

4 Claims, 2 Drawing Sheets

CAPACITOR AND RESISTOR CONNECTION IN LOW VOLTAGE CURRENT SOURCE FOR SPLITTING POLES

BACKGROUND OF THE INVENTION

1. Field of the Invention

This invention relates to current sources which provide a constant current through variations in the supply voltage and, more particularly, to a small size, low voltage current source.

2. Description of Related Art

The function of a current source circuit is to supply a substantially constant output current, despite fluctuations in supply voltage, temperature, or other operating conditions.

A low voltage current source has been designed for use on the LT1073 series of switching regulator integrated circuits from Linear Technology Corporation (LTC).

An equivalent schematic of the LTC current source is shown in FIG. 1. PNP transistors Q4 and Q5 are shown, each having three collector terminals and each electrically identical to three separate transistors. The circuit is supplied a voltage $V_{ss}$ from a voltage supply terminal. The base terminals of the transistors Q4 and Q5 are connected in common so that transistor Q5 acts as a current mirror. The output currents $I_c$ on the collectors 10 and 12 of transistor Q4 are the same.

NPN transistors Q2 and Q3 have their collectors connected to collectors 10 and 12, respectively, so that current $I_c$ flows through each of transistors Q2 and Q3. The bases of transistors Q2 and Q3 are connected in common and are connected directly to the collector of transistor Q3.

Transistor Q3 is sized to have an emitter area ten times as large as the emitter area of transistor Q2. Thus, the $V_{BE}$ of transistor Q3 will be less than the $V_{BE}$ of transistor Q2 when these transistors are drawing the same current $I_c$. In the circuit of FIG. 1, it is assumed that the $V_{BE}$ of transistor Q2 is about 0.7V while the $V_{BE}$ of transistor Q3 is about 0.64V. Thus, the emitter voltage of transistor Q3 is 60 mV.

The emitter of transistor Q3 is connected to ground through resistor R4, having a value of 15K ohms. Thus, the current $I_c$ through transistor Q3 and resistor R4 equals 60mV/15K ohms or 4 $\mu$A. Since transistor Q5 is connected as a current mirror with transistor Q4, the output current $I_0$ of transistor Q5's collector terminal 14 will be the same as $I_c$ (i.e., 4 $\mu$A).

Regulation of current $I_0$ with changes in $V_{ss}$ is as follows. Transistor Q1 is connected between transistors Q4 and Q2 to provide a feedback control signal to the base of transistor Q4. The collector terminal of transistor Q2 is connected to the base terminal of transistor Q1, and, therefore, the collector voltage of transistor Q2 controls the conductivity of transistor Q1, which in turn controls the conductivity of transistor Q4 and the current $I_c$. Resistor R3, connected between the emitter of transistor Q1 and ground, reduces the loop gain, making it easier to stabilize the loop.

As the supply voltage $V_{ss}$ increases, the collector-to-emitter voltage of PNP transistor Q4 increases. Since transistor Q4 has a finite output impedance, this increases current $I_c$. This increased current flows into the collector of transistor Q3 and through resistor R4. If transistor Q4's collector 12 current $I_c$ becomes greater than 60 mV/R4, the additional current will raise the IR drop across resistor R4 to greater than 60 mV, thereby raising the base-emitter voltage ($V_{BE}$) of transistor Q2. Since the IR drop across resistor R4 rises linearly with an increase in $I_c$ and transistor Q2's collector current increases exponentially as its $V_{BE}$ increases, transistor Q2's collector current will increase more than transistor Q3's collector current $I_c$ increases. Therefore, transistor Q2's collector voltage decreases when Ic rises above 60 mV/R4. This, in turn, lowers the conductivity of transistors Q1 and Q4 and decreases $I_c$.

Conversely, if $V_{ss}$ decreases, and $I_c$ becomes less than 60 mV/R4, transistor Q2's collector voltage will increase, leading to an increase in $I_c$. Thus, the circuit of FIG. 1 uses negative feedback in order to keep $I_c$ and $I_0$ constant regardless of changes in $V_{ss}$.

A feedback system must be properly compensated to ensure that the feedback loop will not oscillate. In FIG. 1, a capacitor C1 of 40 pF is placed between the collector terminal of transistor Q2 and the collector-base terminal of transistor Q3 in order to stabilize the feedback loop.

In FIG. 2, this original feedback circuit has been redrawn to make the feedback loop easier to analyze. Note that C1 has been repositioned with a series resistor $R_x$ that is equal to the forward biased base/emitter diode resistance ($r_e$) of transistor Q3 plus R4. The value of $R_x$ is therefore (26 mV/4 $\mu$A)+15K$\Omega$=21.5K$\Omega$. This is the A.C. equivalent of capacitor C1 connected between transistor Q1's base and transistor Q3's collector-base.

The RC network of capacitor C1 and resistor $R_x$ stabilizes the feedback loop by creating at the base of transistor Q1 a dominant pole with a frequency of approximately 2.5 KHz. The zero ($\frac{1}{2}\pi R_x C1$) is calculated to be around 185 KHz. Creating a dominant pole at 2.5 KHz and a zero at 185 KHz ensures that the feedback loop gain will reach 0 dB prior to a phase shift of $-180°$ in the loop.

A major shortcoming of the circuit of FIG. 1 is that the die size is very large, due to the high capacitance required of its feedback capacitor C1. The die area of the capacitor could be greater than that of all the other circuit components combined, when fabricated on an integrated circuit. A smaller value of the capacitance providing equivalent or better feedback loop stabilization would lead to a significant reduction in the die area of the circuit, resulting in a major improvement. It is therefore desirable to design a substitute for the circuit of FIG. 1 which has a smaller feedback capacitor and a correspondingly reduced die size.

SUMMARY

One embodiment of this invention provides an improved version of an existing current source circuit. The inventive current source preserves the same advantages of the prior art current source, namely high quality line regulation at low supply voltages, but has a much reduced die size.

In accordance with the preferred embodiment of the present invention, the reduction in die size of the current source is achieved by modifying the circuit to enable a reduction in the capacitance of its feedback capacitor while improving the frequency compensation of its feedback loop. The modification changes the location of the dominant pole in the circuit and utilizes Miller multiplication to increase the effect of the feedback capacitor. The modification also results in pole splitting by increasing the frequency of the second-most dominant pole. The combination of changing the dominant pole and causing pole splitting ensures that the feedback loop will be stable even though the circuit uses a much smaller capacitor than the prior art circuit.

DETAILED DESCRIPTION OF THE PREFERRED EMBODIMENT

Figure 1:
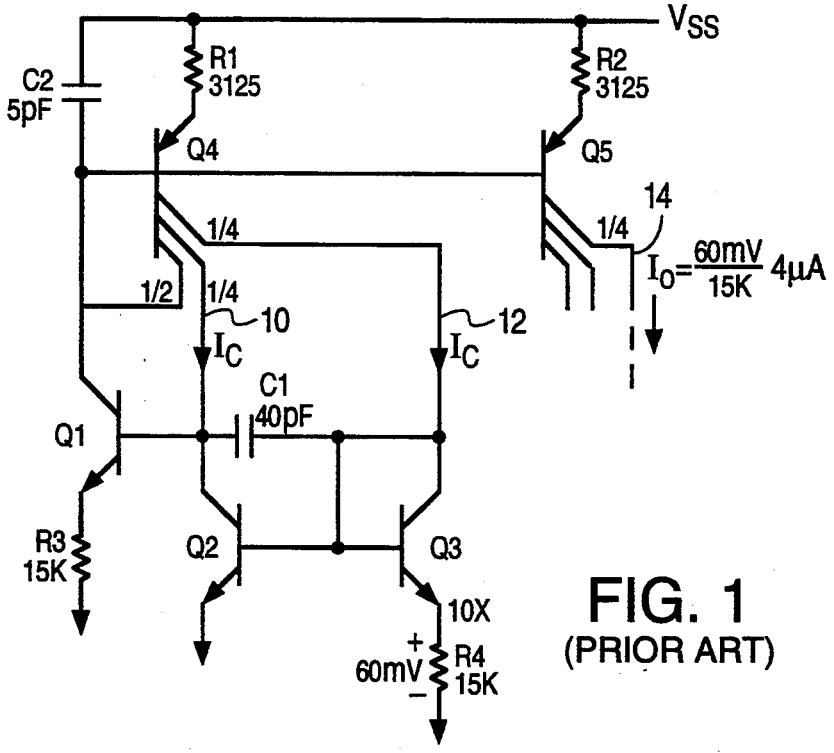
FIG. 1 (PRIOR ART)
FIG. 1 is a schematic diagram of the original current source circuit for the LT1073 series of switching regulators.
Figure 2:
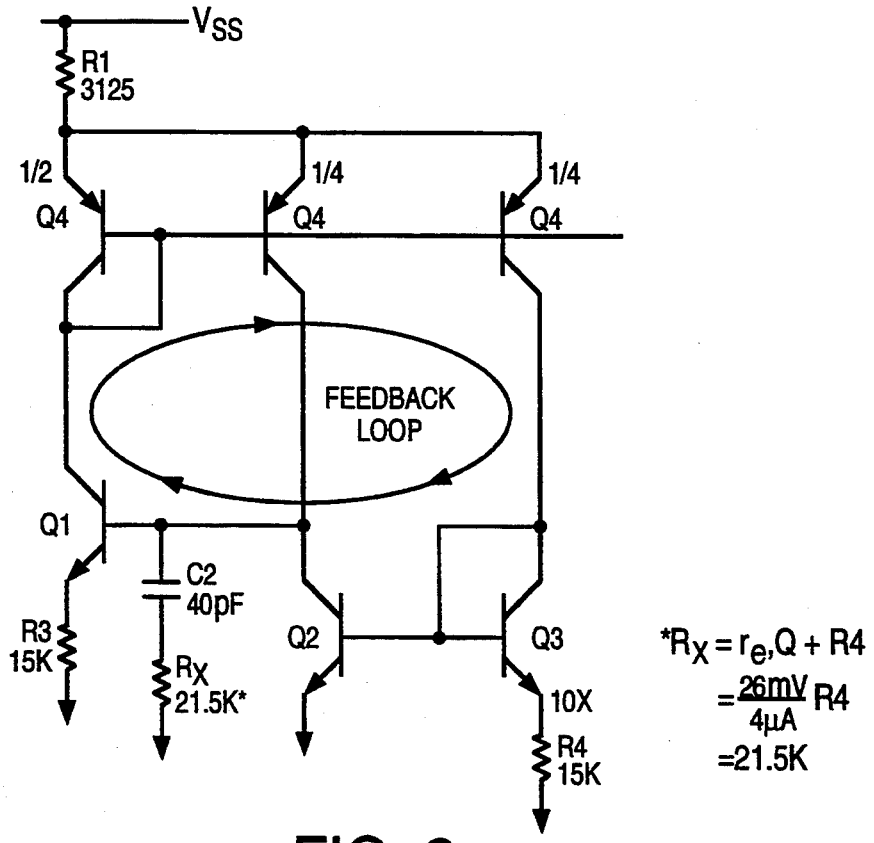
FIG. 2 (PRIOR ART)
FIG. 2 is an equivalent diagram of the feedback loop in the circuit of FIG. 1.
Figure 3:
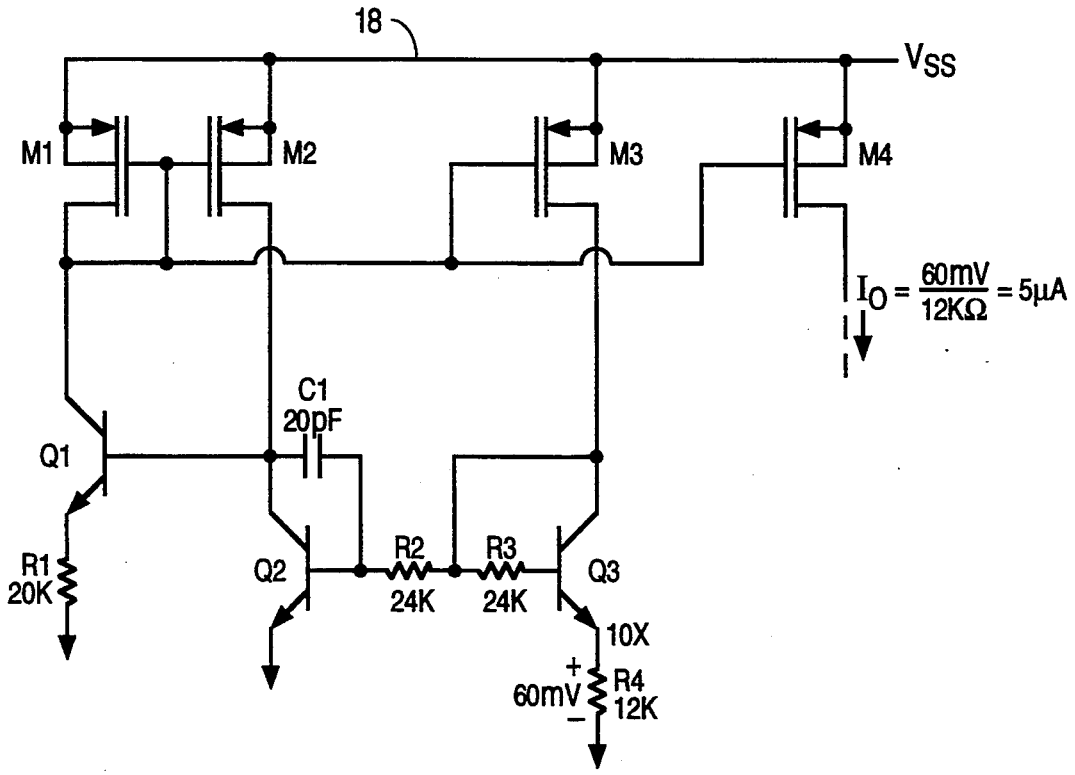
FIG. 3 is a schematic diagram of the preferred embodiment of the present invention.

An improved version of the current source of FIG. 1 is shown in FIG. 3, which is the preferred embodiment of the present invention. Due to certain circuit modifications, this circuit needs only about half the stabilizing capacitance value of the original circuit in order to adequately stabilize its feedback loop.

In this circuit, the PNP transistors of FIG. 1 are replaced by P-channel MOSFETs M1, M2, M3, and M4, all having the same channel width-to-length ratio. The NPN bipolar transistors Q1, Q2, and Q3 in FIG. 3 have the same basic functions as the transistors Q1, Q2, and Q3, respectively, in FIG. 1. The collector voltage of transistor Q2 in FIG. 3 controls the conductivity of transistor Q1, which, in turn, regulates the output current $I_0$.

Transistors M1, M2, M3, and M4 have their source terminals connected in common to the voltage supply line 18, and transistors M1, M2, and M3 are connected in series with transistors Q1, Q2, and Q3, respectively. The gates of transistors M1, M2, M3, and M4 are made common.

Since the drains of transistors M1, M2 and M3 are connected to the respective collectors of transistors Q1, Q2 and Q3, the current drawn from transistors M1, M2 and M3 flow through transistors Q1, Q2, and Q3. The output current $I_0$ of the circuit is provided by the drain of transistor M4.

Resistor R1, connected between the emitter of transistor Q1 and ground, reduces the loop gain, making it easier to stabilize the loop.

The reduction in the capacitance of the feedback capacitor C1 is accomplished by connecting a 24K ohm resistor R2 between the base of transistor Q2 and the collector of transistor Q3. This makes the base of transistor Q2 a high impedance node, allowing the integrator of capacitor C1 and transistor Q2 to create a dominant pole at the base of transistor Q2 to stabilize the feedback loop. In this configuration, the Miller multiplication effect of transistor Q2 is utilized to increase the stabilizing effect of capacitor C1. Assuming that transistor Q2 has a voltage gain of 350 and the value of capacitor C1 is 20 pF, the integrator creates a dominant pole at the base of transistor Q2 with a value around 500 Hz. With such a dominant pole, no oscillations in the feedback loop will occur.

Hence, the present configuration moves the dominant pole of the prior art circuit to the base of transistor Q2 to improve the overall operation of the circuit.

The value of resistor R2 could be further increased to enable use of an even smaller value capacitor C1. For example, resistor R2 could be 48K ohms and capacitor C1 could be 17 pF.

In addition to creating a dominant pole at the base of transistor Q2, the integrator stage reduces the impedance at the base of transistor Q1 at higher frequencies (since transistor Q2 will act as a diode at the base of transistor Q2), thereby increasing the frequency of the non-dominant pole at that node. Hence, the novel circuit modification incorporated into the circuit of FIG. 3 also introduces pole splitting to separate the dominant pole frequency and the second most dominant pole frequency. Since the feedback loop gain must be made to fall to 0 dB at a frequency below the second most dominant pole for adequate phase margin, the raising of the frequency of this second most dominant pole increases the realizable bandwidth of the circuit.

To offset the IR drop of resistor R2, resistor R3 is connected in series with the base of transistor Q3.

The circuit of FIG. 3 operates as follows.

Equal currents flow through transistors M2 and M3 as well as through transistors Q2 and Q3, since the gates of transistors M2 and M3 are made common and the bases of transistors Q2 and Q3 are equally biased. The transistor Q3 is formed to have an emitter area ten times that of transistor Q2. Assuming that the $V_{BE}$ of transistor Q2 is 0.7V, the $V_{BE}$ of the larger transistor Q3 will be about 0.64V, causing the emitter voltage of transistor Q3 to be about 60 mV. The current through resistor R4, connected between the emitter of transistor Q3 and ground, will thus be 60 mV/R4 or 5 $\mu$A, given that R4 is 12K ohms.

Since transistor M4 is connected as a current mirror with transistor M3, an output current $I_0$ of 5 $\mu$A at the drain of transistor M4 will be generated.

Since the collector of transistor Q2 is connected to the base of transistor Q1, and the collector of transistor Q1 is connected to the gates of transistors M1, M2, M3, and M4, the conductivity of transistor Q1 will be automatically set by the resulting feedback loop to cause transistors M1–M4 to each generate 5 $\mu$A. If $V_{SS}$ were to rise, the current through transistor M3 would increase. If this current increased above 60 mV/R4, this increased current would increase the base bias voltage of transistor Q2 and increase the conductivity of transistor Q2. This would lower the base voltage of transistor Q1, thus making transistor Q1 less conductive and raising the gate voltage of transistors M1–M4. This rise in the gate voltage of transistors M1–M4 reduces the current through transistors M1–M4 to offset the increase in $V_{SS}$ and maintain the current through transistors M1–M4 at 60 mV/R4. An opposite feedback correction occurs when $V_{SS}$ dips.

As previously described, capacitor C1 damps the feedback loop to prevent oscillations, and the use of resistors R2 and R3 allow a relatively small size capacitor C1 to be used while improving the frequency compensation of the feedback loop. Hence, the die size of the circuit of FIG. 3 is thereby considerably reduced from that required for the circuit of FIG. 1.

Although the present invention has been described with reference to the preferred embodiment of FIG. 3, it will be obvious to those skilled in the art that changes and modifications may be made in form and detail in the embodiment described above without departing from the spirit and scope of the invention. For example, while p-channel MOSFETs have been used to take advantage of the reduced size of MOSFETs, PNP bipolar transistors can be used instead of the p-channel MOSFETs with no effect on the circuit's loop gain and no significant change in C1. Such PNP transistors may be formed to have multiple collectors or may be equivalently formed as separate transistors. The appended claims are therefore intended to cover all such modifications within the scope of the claims.

What is claimed is:

1. A circuit for providing a substantially constant current source comprising:

three input transistors, each of said three input transistors having a control terminal for controlling a current flowing between a first current carrying terminal and a second current carrying terminal of each of said input transistors, said input transistors having their respective first current carrying terminal connected to a voltage supply terminal, said input transistors sharing a common control terminal;

an output transistor having a control terminal for controlling a current flowing between a first current carrying terminal and a second current carrying terminal of said output transistor, said output transistor having its first current carrying terminal connected to said voltage supply terminal and having its second current carrying terminal serving as an output terminal for an output current of said constant current source;

a first bipolar transistor having a collector connected to said second current carrying terminal of a first of said input transistors, an emitter of said first bipolar transistor being connected to a reference voltage;

a second bipolar transistor having a collector connected to said second current carrying terminal of a second of said input transistors, said second bipolar transistor having a larger emitter area than said first bipolar transistor;

a feedback stabilizing capacitor connected between a base of said first bipolar transistor and said collector of said first bipolar transistor;

a first resistor connected between said base of said first bipolar transistor and said collector of said second bipolar transistor;

a second resistor connected between a base of said second bipolar transistor and said collector of said second transistor, said second resistor being substantially equal in value to said first resistor;

a third resistor connected to an emitter of said second bipolar transistor, said third resistor setting said output current of said constant current source; and a third bipolar transistor, said third transistor having its base connected to said collector of said first bipolar transistor and having its collector connected to said second current handling terminal of said third of said input transistors, an emitter of said third bipolar transistor being connected to said reference voltage through a fourth resistor, wherein a resistance value of said first resistor between said base of said first bipolar transistor and said collector of said second bipolar transistor allows said capacitor and said first bipolar transistor to act as an integrator and create a dominant pole at said base of said first bipolar transistor and, at the same time, raise a frequency of a non-dominant pole at said base of said third transistor to prevent a feedback loop in said circuit from oscillating.

2. The circuit of claim 1, wherein said input transistors are MOSFETs.

3. The circuit of claim 1 wherein said capacitor has a value of between approximately 15 pF and 25 pF.

4. The circuit of claim 3, wherein values of said first resistor and said second resistor are between approximately 20K ohms and 60K ohms.

* * * * *